United States Patent [19]

Bryan

[11] 4,334,373

[45] Jun. 15, 1982

[54] COMBINED FLAT SHEET DISPLAY DEVICE AND ROLLED SHEET HOLDER

[76] Inventor: Carl N. Bryan, P.O. Box 325, Winter Haven, Fla. 33880

[21] Appl. No.: 105,283

[22] Filed: Dec. 19, 1979

[51] Int. Cl.[3] ..... G09F 3/18; G09F 11/18

[52] U.S. Cl. ..... 40/19; 224/277; 40/10 D; 40/514

[58] Field of Search ..... 40/10 R, 10 A, 10 B, 40/10 D, 16, 19, 490, 491, 611, 616, 124, 124.2, 158 R, 159; 224/277; 206/461, 477, 468, 481

[56] References Cited

U.S. PATENT DOCUMENTS

| | | | |
|---|---|---|---|
| 1,270,475 | 6/1918 | Wilkenson | 40/152 |
| 1,617,718 | 2/1927 | Mellin | 40/10 B |
| 1,798,401 | 3/1931 | Danielson | 40/10 A |
| 1,827,167 | 10/1931 | Regan | 40/611 |
| 2,173,306 | 9/1939 | McDonnell | 40/16 |
| 2,201,789 | 5/1940 | Robilotto | 244/277 X |
| 2,211,559 | 8/1940 | Erickson | 224/277 X |
| 2,628,008 | 2/1953 | Innis | 40/10 R |
| 2,811,799 | 11/1957 | Clark | 40/152 |
| 3,127,011 | 3/1964 | Weddle | 206/45.34 |
| 3,156,055 | 10/1964 | Hennessy | 40/19 |
| 3,466,774 | 9/1969 | Borresen | 40/10 R |
| 3,874,103 | 4/1975 | Muta | 40/10 D |

FOREIGN PATENT DOCUMENTS

| | | | |
|---|---|---|---|
| 1280830 | 7/1972 | United Kingdom | 40/10 A |

*Primary Examiner*—Gene Mancene
*Assistant Examiner*—Michael J. Foycik, Jr.
*Attorney, Agent, or Firm*—Lowe, King, Price & Becker

[57] ABSTRACT

A combination building permit display device and rolled blueprint holder is provided. The permit and the blueprints are protected from the elements and yet are readily accessible by authorized persons, such as the building inspectors. The base member of the device is formed by a single sheet of plastic and the translucent cover sheet for the permit is mounted by slots cut in a raised frame on the base member. A holder tube stores the rolled blueprints adjacent the permit and the tube is closed at the top for protection from the weather. Ring brackets or, in the alternative, hook brackets mount the tube for quick removal and replacement. A raised reinforcement rail is provided along the side of the base member adjacent the tube.

3 Claims, 10 Drawing Figures

COMBINED FLAT SHEET DISPLAY DEVICE AND ROLLED SHEET HOLDER

FIELD OF THE INVENTION

The present invention relates to display devices, and more particularly, to a combination display and holder device for sheet material.

BACKGROUND OF THE INVENTION

In the building industry, it is a common requirement that a building permit be prominently displayed at the site of the construction. This building permit, issued by the local authorities, is usually a printed cardboard sheet. The building permit sheets usually include printing setting forth the basis of the permit and providing checkoff blocks for the various inspectors of the local government. The building permit sheet when left exposed rapidly deteriorates from being exposed to the elements at the building site. The initials of the building inspectors often are obliterated by rain, mud or other debris.

In the past, rather futile attempts have been made to protect the building permit as it is put up on a tree or post at the building site. The most common approach is to wrap the building permit in a plastic drycleaning garment bag or the like. As will be surmised, this has not been successful since the wind and other factors soon dislodge the plastic leaving the building permit exposed. This most commonly occurs after an inspector has had to lift the plastic to check off his particular block. By the time the final inspector comes around, the building permit is oftentimes not intelligible and valuable time is wasted by having to doublecheck the various checkoffs. Furthermore, it is also a problem that the building permit will itself be completely blown away during high winds and this causes additional inconvenience and loss of time since a substitute permit must then be obtained and erected at the building site.

In addition to the above shortcomings of the current practice of displaying the building permit exposed to the elements, it will be readily realized that such a display of the building permit is unsightly. With the permit bent, torn and splattered with mud, it is particularly upsetting to the prospective owner of the house or building, and in addition provides a bad image for the lending institution and/or the contractor which also usually has a sign on the premises advertising their participation in the project.

Furthermore, in many jurisdictions, in addition to the building permit, the plans of the building must be located in a convenient place on the building site. In many instances, the inspectors or other interested parties forget to bring the blueprints when visiting the construction site, and time is wasted having to return to the office to obtain another set of blueprints. In instances where the blueprints are temporarily attached to the same tree or post as the building permit, a sudden rain or wind storm can quickly destroy them.

Thus, an objective of the present invention is to provide a protective display device for the building permit, and in conjunction therewith a protective holder for the rolled blueprints.

It is another object of the present invention to provide a display device that is not only functional but attractive to enhance the image of the companies associated with the building project.

It is still another object of the present invention to provide a display device for a flat sheet that is simple in design and provides weather-proofness and yet easy access by the building inspectors and others, as required.

BRIEF DESCRIPTION OF THE INVENTION

A flat sheet display device combined with a rolled sheet holder device is provided by the device of the present invention. A base member, formed of plastic, such as ABS plastic, high density polyethylene or the like, includes a raised frame to form a recess for receiving the flat sheet. A tube, having the top closed and mounted in brackets next to the frame provides the holder for the rolled sheet. The device of the present invention is particularly adapted for use in the construction field for displaying a building permit and storing the related rolled building blueprints. However, it is to be understood that other possible uses may be identified and that the device is thus anticipated as being useful in other environments.

In order to protect the flat sheet that is displayed, a transparent or translucent cover is mounted in the frame of the base member. Advantageously, this cover may be easily installed or removed for cleaning by a slot formed along the top piece of the frame and corresponding slots in frame extensions adjacent the open bottom. A raised projection mounted on a resilient tongue supports the flat sheet within the frame and can be easily depressed for release of the flat sheet for closer inspection and to allow easy checkoff on the sheet, especially when the sheet is a building permit or the like. The tube holding the rolled sheet or blueprints is supported along the side of the base member by support rings and a shelf adjacent the bottom of the device. Because the top of the tube is closed, the blueprints are protected from the elements. Alternatively, the holding rings for the tube may be replaced by upstanding hooks that fit within openings in the back of the tube to hold the tube in position.

The frame, which comprises raised areas on the base plate, serves to reinforce the base member and thereby make the device sufficiently rigid to withstand wind and other abuses. Furthermore, a special side rail is molded into the base plate along the holder tube to further reinforce the device. The top piece of the frame may be sufficiently wide to receive an advertising message, such as by a lending institution that is providing the financing of the project. It is anticipated that lending institutions may distribute the device of the present invention to contractor customers to replace their usual signs at the building site.

DETAILED DESCRIPTION OF PREFERRED EMBODIMENT

Figure 1:
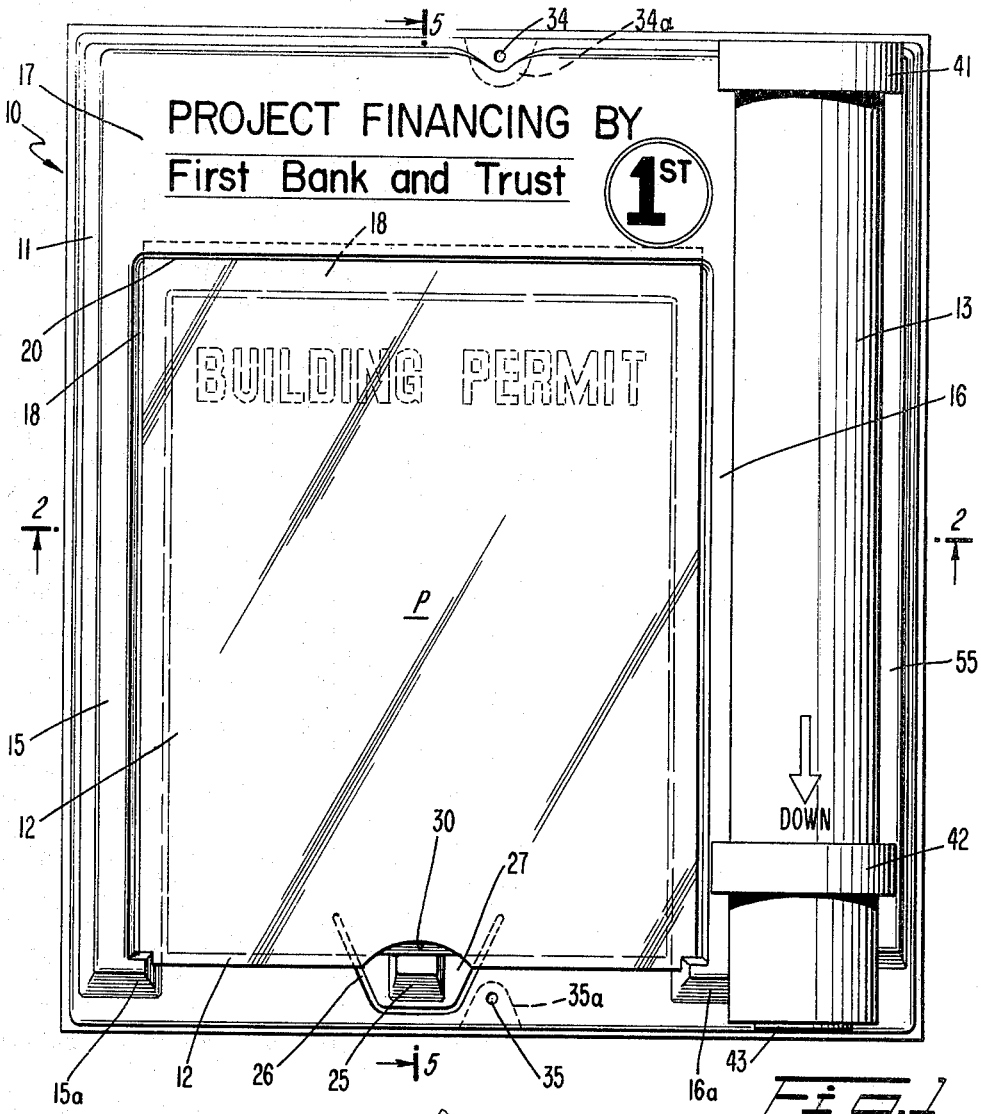
FIG. 1 is a front view of the display and holder device showing the use in a construction environment so as to display a building permit.

For more complete understanding of the sheet display and holder device of the present invention, reference should now be made to the drawings, starting with FIG. 1. In this figure, a combination flat sheet display and rolled sheet holder device 10 is shown including a base member 11, a cover of transparent plastic 12 and a holder tube 13 along one side of the base member 11. In the preferred embodiment, the device 10 is particularly adapted for holding a building permit P as a flat sheet for display at a building site. The holder tube 13 is particularly adapted in the preferred embodiment to hold a rolled group of blueprints B (see FIG. 8). As will be seen in more detail below, the construction of the device 10 is such as to protect both the building permit P and the blueprints B from the elements, and thus the device is particularly adapted for outdoor use.

Preferably, the base member 11 is molded from a single sheet of plastic, such as ABS plastic or high density polyethylene. These plastics are sufficiently rigid to withstand wind forces and also are not affected by exposure to the sun or rain.

Integral with the base member 11 is a raised frame (FIG. 1 and FIG. 2) having opposed side pieces 15, 16 and a top piece 17. In the preferred embodiment, advertising is advantageously added to the top piece 17 of the frame which may include the name of a lending institution and/or its logo (see FIG. 1).

Figure 2:
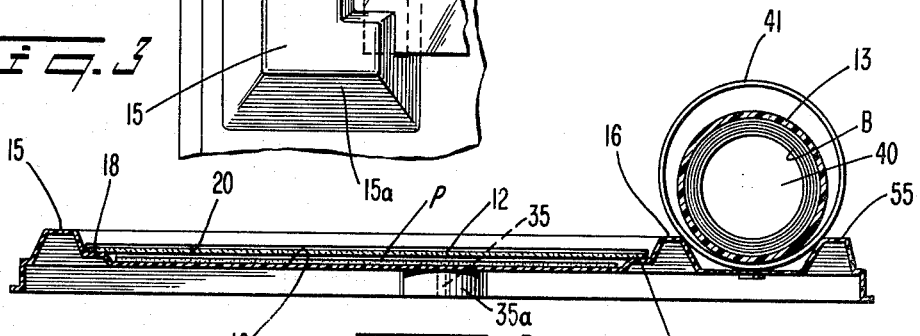
FIG. 2 is a cross-sectional view taken along line 2—2 of FIG. 1.
Figure 4:
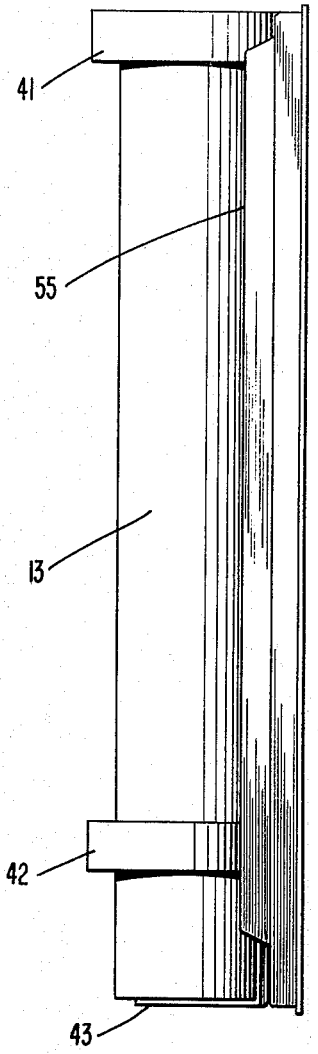
FIG. 4 is a right side view of the display and holder device.

A shoulder is provided immediately inside the perimeter of the frame pieces 15–17, and this shoulder is designed by reference numeral 18 (see FIGS. 1 and 2). The shoulder 18 supports the transparent cover 12 thereby forming a recess 19 (see FIG. 2) in which the building permit P is mounted for display.

Figure 3:
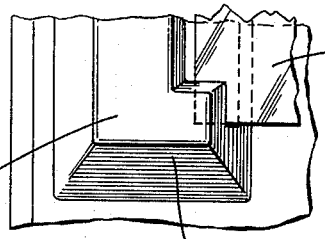
FIG. 3 is an enlarged detailed view of the corner of the frame of the device.

The cover 12, which may be clear, or colored acrylic glazing, such as Plexiglas, is securely held on the base member 11 in a unique manner. Viewing FIG. 5, an elongated slot 20 extends across the full width of the frame top piece 17. The cover 12 enters this slot 20 as guided by the shoulder 18 (see FIG. 1). The bottom of the frame side pieces 15, 16 have frame extensions **15*a*, 16*a*, respectively, and within these extensions are formed corresponding opposing slots (see FIG. 3) that capture the respective lower corners of the cover 12. Thus, it will be realized that the installation and removal of the cover 12 is a simple process. To install it, the upper edge is inserted into the slot 20, moving the cover 12 upwardly to clear the extensions 15*a*, 16*a* (see dotted line outline of FIG. 8), and then letting the cover drop back into the corner slots of the frame extensions 15*a*, 16*a*. In this position, the cover cannot be removed without positive action since it is held in position by gravity due to the vertical mounting of the device 10. Lateral movement of the cover 12 is impossible due to the restraining frame side pieces 15, 16**.

The simplicity of the design of the cover 12 is particularly attractive. To mount the cover 12 requires no fasteners or adhesive of any kind. Rain water or mud splatters or any other foreign matter cannot reach the building permit P or hinder the easy installation or removal of the cover. The upper lip on the outside of slot 20 (see FIG. 5) allows water to simply flow down from the upper frame piece 17 directly onto the cover 12 below the upper edge and thus away from the underside of the cover 12. Rain hitting the sides along the shoulder 18 is also directed down and harmlessly away from the building permit P. The open bottom provides good circulation of air and thus prevents the buildup of significant condensation.

Figure 5:
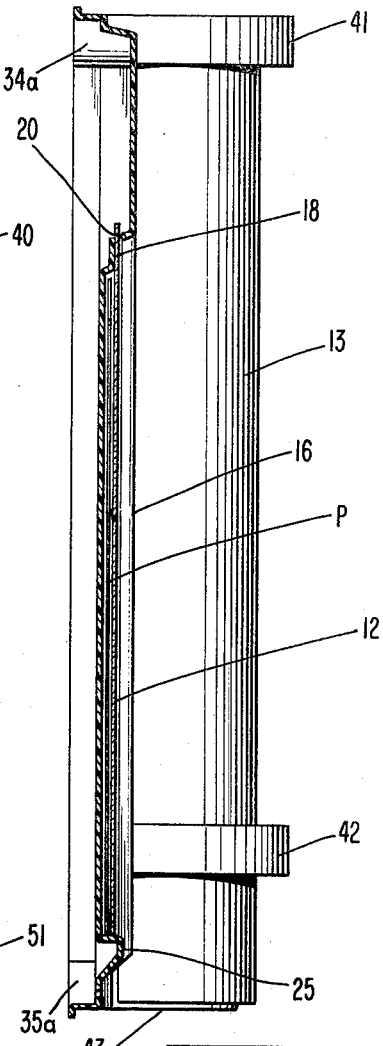
FIG. 5 is a cross-sectional view of the display and holder device taken along line 5—5 of FIG. 1.

The lower edge of the permit P is engaged by the upper face of a projection 25 (see FIGS. 1 and 5). This projection is surrounded on three sides by a continuous cutout 26 thereby forming a resilient tongue 27. This mounting allows the projection 25 to move away from the open bottom of the frame for easy insertion of the permit P, and likewise for easy removal when necessary. Simple thumb pressure against the front of the projection 25 releases the permit P by causing the upper face of the projection 25 to move sufficiently to the rear to release the lower edge of the permit P (note movement arrow in FIG. 5).

Figure 8:
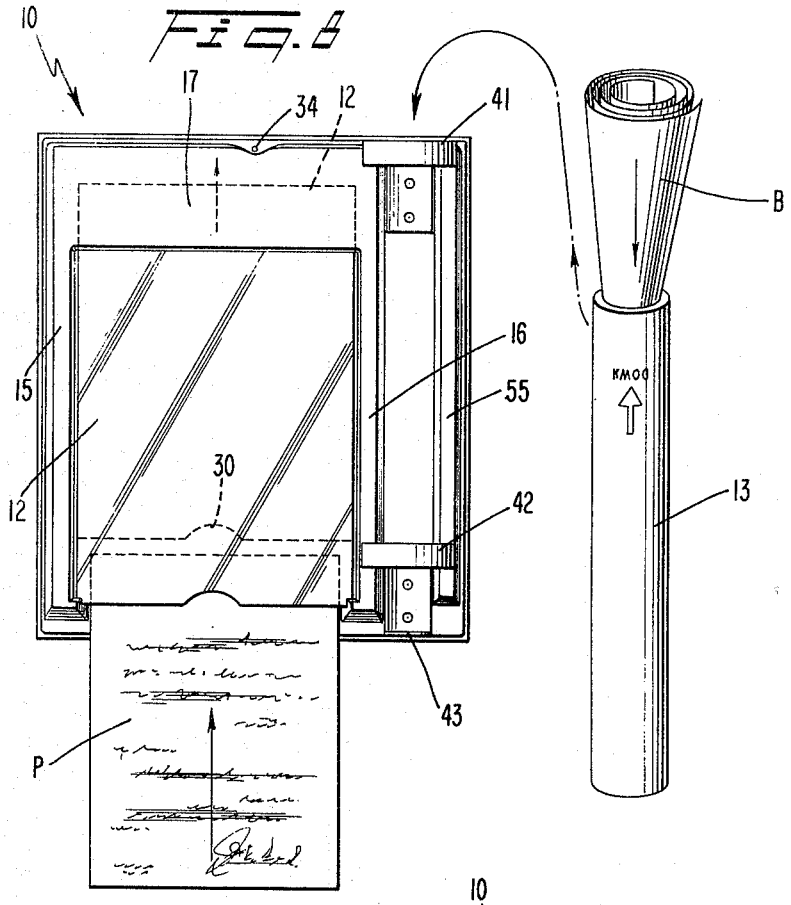
FIG. 8 is a front view showing the removal of the flat sheet for checkoff or the like and showing the storage of the blueprints in the tube.

An alternative manner of inserting and removing the building permit P is simply by engaging notch 30 in the lower edge of the cover 12 and simply moving the cover 12 upwardly to the dotted line position shown in FIG. 8. This would then allow the permit to be simply flexed at the bottom and withdrawn as necessary. After the necessary checkoff by the inspector or the like is completed, the top of the permit P can then simply be slipped beneath the raised lower edge of the sheet 12, slid into position with the lower edge engaged by the projection 25 and the cover 12 lowered to its home position, as shown in the figure. In the event where all of the inspector checkout boxes are located in the approximate lower $\frac{1}{3}$ of the permit P, the inspector can simply raise the cover 12, initial the appropriate box using the plastic base member 11 as a backup and then simply drop the cover 12 back in position with the lower corners entering and securely engaging the slots in the frame extensions **15*a*, 16*a***.

The combined sheet display and holder device of the present invention is adapted for vertical mounting outdoors by the provision of simple upper and lower mounting holes 34, 35, respectively (see FIG. 1). Tapered reinforcing blocks **34*a*, 35*a* (see FIGS. 1 and 2) may be provided behind these holes. The display device 10** is thus easily mounted on a tree or a post at the construction site by simple nails or screws.

The tube 13 for holding the rolled sheets, such as blueprints or plans B, is preferably fabricated of conventional 2" PVC plastic pipe. A top 40 is simply attached by glue to the upper end of the pipe and forms weather protection for the rolled-up sheets in the tube. In accordance with the preferred embodiment, the tube is held along the side of the base member 11 opposite the frame 15–17 by upper and lower ring brackets 41, 42. These brackets may be attached by any suitable means to the base member 11, such as by rivets (see FIG. 8). An outwardly extending shelf 43 is provided on the lower bracket to form a stop for the tube 13 and the blueprints B.

Figure 9:
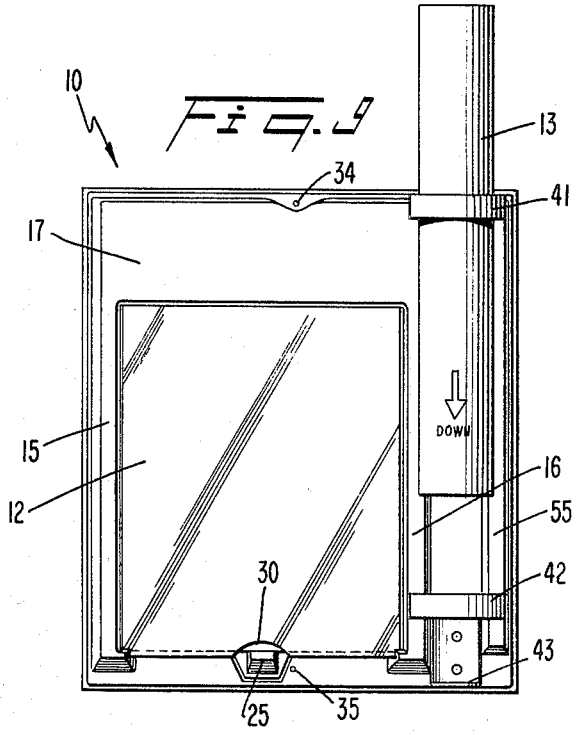
FIG. 9 is a front view of the display and holder device showing the manner in which the tube is mounted on the device.

Normally the blueprints are rolled up to be inserted in the tube 13, then the tube 13 is held upsidedown while blueprints B are inserted, as shown by the arrow in FIG. 8. Once inside the tube 13, the blueprints are released and have sufficient elastic memory to slightly uncoil so as to be held by friction against the inner wall of the tube 13. The tube is then inserted through the upper ring 41, down through the lower ring 42 (see FIG. 9) and the lower edge comes to rest against the shelf 43 (see the bottom view, FIG. 6).

Figure 6:
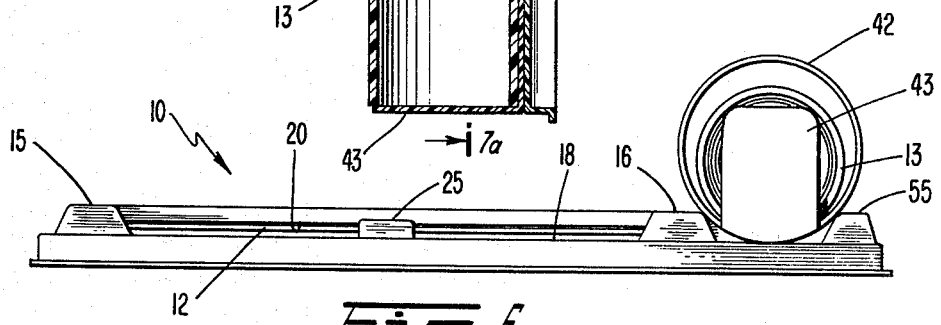
FIG. 6 is a bottom view of the display and holder device of the present invention.

The shelf 43 is also preferably of a size as shown so as to prevent any papers that happen to be loosely rolled in the tube 13 from falling out. Sufficient ventilation of the inside of the tube is provided by the open spaces along the three sides of the bottom edge of the tube, as shown in FIG. 6.

Figure 7:
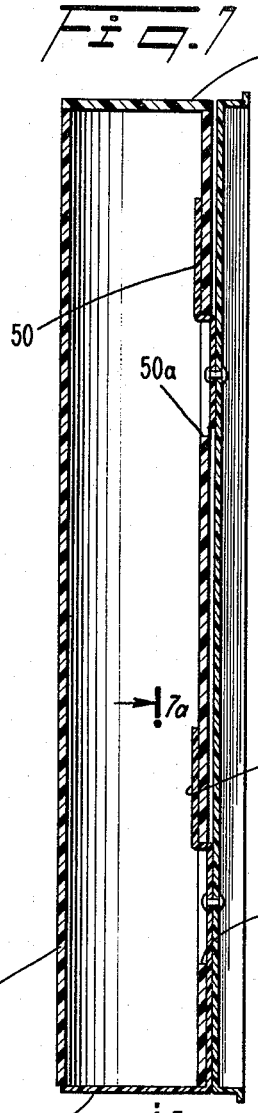
FIG. 7 is a cross-sectional view taken through the holder tube for the rolled sheet showing alternative hook mounting means for the tube.
Figure 7A:
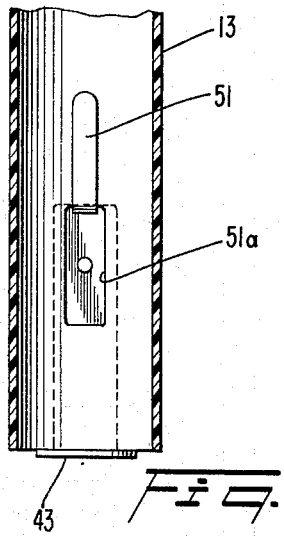
FIG. 7*a* is a cross-sectional view taken along line 7*a*—7*a* of FIG. 7 showing the alternative hook mounting means for the holder tube.

An alternative arrangement for attaching the tube 13 to the base member 11 is shown in FIGS. 7, 7*a*. Upper and lower hooks 50, 51 are attached to the base member 11 and extend upwardly so that after entering the inside of the tube through corresponding openings 50*a*, 51*a*, the tube 13 is held in position. An outwardly extending shelf 43 may also be provided on this embodiment to help hold the tube 13 and its contents. When it is desired to release the tube 13 from the base member 11, the tube is simply raised upwardly until the hooks 50, 51 are opposite the openings 50*a*, 51*a* whereupon the tube can simply be pulled outwardly and the contents removed. The hooks 50, 51 are relatively thin plastic and curved at the top so that there is minimal interference with the contents of the tube in the mounted position.

To further strengthen the base member 11, a raised side rail 55 is provided along the edge where the tube 13 is mounted. This adds significant stiffness to the device and in addition the rail 55 and the side piece 16 of the frame provides a confining recess for the tube 13 (note FIG. 8).

From the foregoing description, the results and advantages of the combination display and holder device 10 of the present invention can now be realized. The building permit P is effectively protected by the transparent cover 12 so that it remains clean and legible. The blueprints B that accompany the building permit P are conveniently mounted in the tube 13 and are also protected from the elements. The base member 11 is formed from a single molded plastic sheet. The cover 12 is mounted for easy insertion and removal and for easy access to the building permit P. The projection 25 may be resiliently mounted on the tongue 27 in order to release only the building permit, as may be desired.

While the present invention has been described in considerable detail, it is understood that various changes and modifications would occur to one of ordinary skill in the art without departing from the spirit and scope of the appended claims.

I claim:

1. A combination flat sheet display and rolled sheet holder device adapted for vertical mounting outdoors comprising a base member, said base member being adapted to receive said flat sheet for display, means to retain said flat sheet on said base member, and holding means positioned on base member to hold said rolled sheet separate from said flat sheet, said holding means being removable from said device for receiving said rolled sheet, said retainer means including a raised frame on said base member including side pieces and a translucent cover within said frame adapted to cover said flat sheet, said base member being an integral sheet of molded plastic, said frame being formed by raised molded areas on said plastic sheet, and said frame serving to reinforce said plastic sheet, a raised reinforcement rail extending along the side of base member opposite said frame, said holding means for said rolled sheet being positioned between said rail and the adjacent side piece of said frame.

2. A combination flat sheet display and rolled sheet holder device adapted for vertical mounting outdoors comprising a base member, said base member being adapted to receive said flat sheet for display, means to retain said flat sheet on said base member, and holding means positioned on base member to hold said rolled sheet separate from said flat sheet, said rolled sheet comprising an upstanding tube closed at the top to prevent entry of precipitation, upper and lower rings mounted in alignment on one side of said base member to receive said tube and an outwardly extending shelf adjacent the lower ring to support said tube.

3. A combination flat sheet display and rolled sheet holder device adapted for vertical mounting outdoors comprising a base member, said base member being adapted to receive said flat sheet for display, means to retain said flat sheet on said base member, and holding means positioned on base member to hold said rolled sheet separate from said flat sheet, said holding means comprising an upstanding tube closed at the top to prevent entry of precipitation, upper and lower openings in the back of said tube and corresponding upper and lower hooks on said base member to fit through said openings to engage said tube adjacent the top of said openings, and an outwardly extending shelf adjacent the lower hook to support said tube.

* * * * *